United States Patent [19]

Soave

[11] 4,254,846

[45] Mar. 10, 1981

[54] APPARATUS AND METHOD FOR REMOVING LINERS FROM THEIR OUTER CONTAINERS

[76] Inventor: Davide A. Soave, 44 Winding Rd., Hicksville, N.Y. 11801

[21] Appl. No.: 41,991

[22] Filed: May 24, 1979

[51] Int. Cl.[3] ..... E04G 5/06; B66F 11/04

[52] U.S. Cl. ..... 182/46; 182/2; 182/222

[58] Field of Search ..... 182/2, 46, 222; 254/136

[56] References Cited

U.S. PATENT DOCUMENTS

| | | | |
|---|---|---|---|
| 3,404,751 | 10/1968 | Nosworthy | 182/46 |
| 3,414,079 | 12/1968 | Wacht | 182/46 |
| 3,642,096 | 2/1972 | Valentine | 182/46 |

*Primary Examiner*—Reinaldo P. Machado

[57] ABSTRACT

An apparatus and method for the removal of insulating liners and the like from their outer containers is disclosed. The apparatus comprises a strap attached to a hook means. The hook means is adapted to engage the upper edge portion of the container and the strap is of sufficient length to extend from the hook means down the corresponding inner side wall portion of the container across the bottom and up and beyond the opposite side wall portion of the container while the liner is fully inserted within the container. The method includes pulling the end of the strap which extends beyond the side wall portion opposite the hook means, thereby forcing the liner from the container.

8 Claims, 7 Drawing Figures

APPARATUS AND METHOD FOR REMOVING LINERS FROM THEIR OUTER CONTAINERS

BACKGROUND OF THE INVENTION

1. Field of Invention

The present invention relates to the removal of liners and the like from their outer housings or containers. More particularly the present invention relates to an assist strap for removing insulating liners from the buckets of aerial lift type trucks.

2. Description of the Prior Art

In the past a variety of means have been used to reduce the hazard of electrical shock to workmen employed near high voltage lines while suspended above ground level in aerial lift type trucks-often referred to as "cherry pickers". The most common means to eliminate or at least reduce this hazard is to insulate the inner walls and bottom of the bucket or container in which the workmen stand. This is accomplished in many instances by inserting a one piece, molded liner made of plastic or other resilient insulating material which completely covers the inner walls and lip of the bucket or container. In practice these liners are sized to close tolerances such that once inserted into the bucket they are quite difficult to remove. In addition, these liners are normally provided with a horizontal lip on their upper edge which contacts the upper edge portion of the bucket when the liner is fully inserted. This lip prevents debris and moisture from entering any intermittent spaces which may exist between the liner and bucket.

Naturally it is necessary that the liners be removed on a regularly scheduled basis for dielectric tests, routine cleaning and drying, as well as visual inspection for physical damage. It is this removal which in many instances damages the liner, resulting in costly replacement. Due to the close tolerances between the liner and the bucket, frictional force sometimes results; this frictional force, in combination with the vacuum which is created between the liner and the bucket, makes any initial upward movement of the liner difficult. To overcome these combined forces it is often necessary to pry the edge or lip of the liner away from the bucket using a screwdriver or other type of prybar. It has been found that removing the liner in this way often results in the edge or lip portion of the liner being broken off. Obviously, when a substantial portion of the edge has been removed the liner must be discarded.

The present invention has overcome the above-mentioned disadvantages in that it provides for a liner removal assist strap for removing a liner by lifting the liner from the bottom rather than by the lip portion thereof.

SUMMARY OF THE INVENTION

In its broadest sense the invention is directed to an apparatus and method for the removal of inner liners from their outer containers. More particularly the present invention is directed to an apparatus and method for the removal of electrical insulating liners from the buckets or containers found on aerial lift type trucks. The apparatus in essence comprises a strap attached to a hook means. In use the hook means is placed over one of the upper side edges of the outer bucket prior to the insertion of the liner. The strap is then placed in a flat position along the inner sides and bottom of the bucket, such that upon insertion of the liner the strap will be positioned between the bucket and liner with the tail end extending beyond the edge of the bucket opposite the hook means. Pulling the tail end of the strap will result in an upward force being exerted on the lower portion of the liner, lifting the liner out of the bucket in a straight and aligned manner.

Accordingly, an object of the present invention is to provide a method and apparatus for the removal of liners from outer containers or buckets.

Another object of the present invention is to provide for a method and apparatus for the removal of electrical insulating liners from the buckets of aerial lift type trucks without damage to the liner.

A further object of the present invention is to provide an apparatus which makes it possible for a single operator to quickly, easily and safely remove an insulating liner from the bucket of an aerial lift type truck.

Still other objects and advantages of the present invention will be obvious and in part be apparent from the specification and attached drawings.

BRIEF DESCRIPTION OF THE DRAWINGS

For a fuller understanding of the invention reference is had to the following description, taken in connection with the accompanying drawings of the preferred embodiment in which.

DESCRIPTION OF THE PREFERRED EMBODIMENTS

Figure 1:
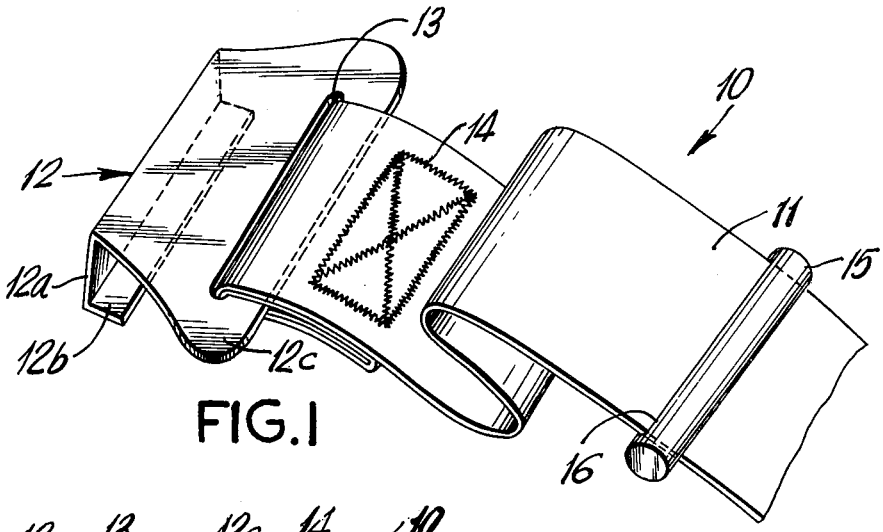
FIG. 1 is a perspective view of the liner removal assist strap.

As shown in the drawings the liner removal assist strap of the present invention comprises a strap having fixably attached at one end thereof a hook means adapted to engage the upper edge portion of a bucket or container.

Figure 2:
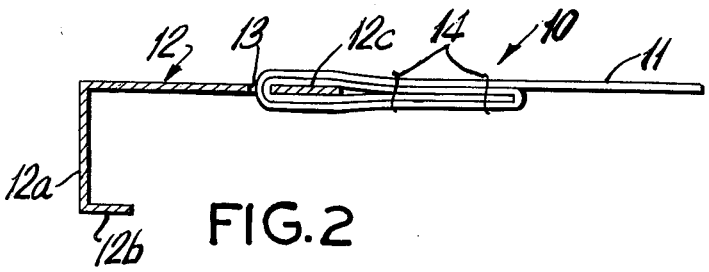
FIG. 2 is a vertical section view of the assist strap showing the strap double wrapped about the hook means.

Referring now more particularly to the accompanying drawings wherein like numerals designate similar parts throughout the various views, attention is directed first to FIG. 1 wherein the assist strap, designated generally by reference number 10, is shown. The assist strap comprises strap 11 having fixably attach to one end hook means 12. Although a number of various methods may be used to attach strap 11 to hook 12, such as the use of rivets or adhesives, it has been found that exceptionally high shear strength may be achieved when strap 11 is "double wrapped" through slot 13 of hook 11 and secured by stitches 14, as shown in FIGS. 1 and 2.

Figure 3:
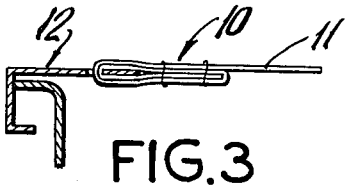
FIG. 3 is a partial vertical section view depicting the hook means attached to the horizontal lip of an outer bucket or container.
Figure 4:
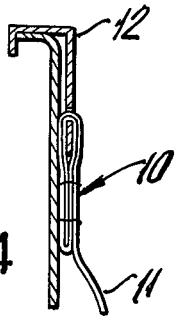
FIG. 4 is a partial vertical section view depicting an alternate way of positioning the hook means on the edge of the outer bucket or container.

As can be seen from the drawings hook 12 is generally U shaped. Although the dimensions of the hook are not critical, care should be taken to assure that section 12*a* of hook 12 is of sufficient width to enable the hook to engage the edge of the bucket; moreover, lip portion 12*b* of hook 12 should be long enough to assure that the hook will not slide off the edge of the bucket yet not too long to prevent section 12*a* from contacting the edge of the bucket as shown in FIG. 3. In many cases the horizontal lip of the bucket is too narrow to support hook 12 in such a manner that portion 12*c* of hook 12 does not extend into the opening of the bucket. In this case hook 12 may be positioned around the entire edge portion of the container, as shown in FIG. 4. Note that in whatever position the hook is placed it is essential that it does not interfere with the insertion of the liner into the bucket.

Figure 5:
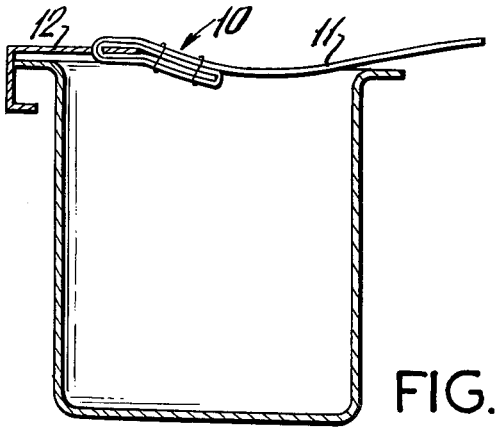
FIG. 5 is a vertical section view of an outer container or bucket depicting the hook of the assist strap attached to the edge of the bucket and the strap portion loosely stretched across the open portion of the bucket.
Figure 6:
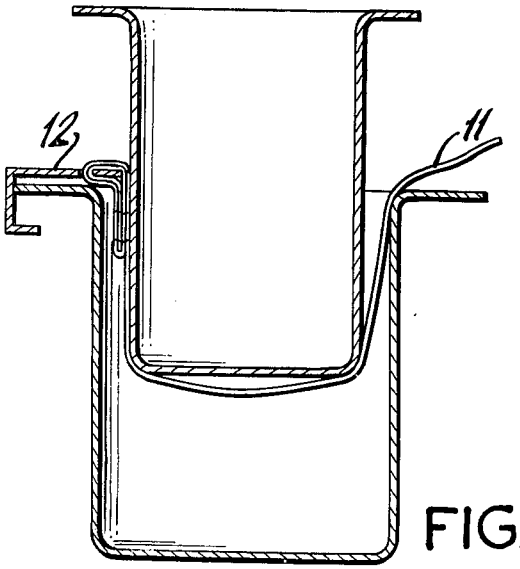
FIG. 6 is a vertical section view of an outer container or bucket depicting a liner partially inserted into the bucket and the assist strap positioned between the liner and the bucket.

Once hook 12 is firmly in place on the edge of the bucket, strap 12 is loosely stretched across the open end of the bucket as shown in FIG. 5. The liner is then inserted into the bucket, forcing the strap down between the liner and the bucket as depicted in FIG. 6. Note that a small opposing force should be applied to the end of the strap while the liner is being inserted so that strap 11 will be biased flatly against the bottom of the liner. Failure to apply this slight opposing force to the strap may cause an excess length of strap to accumulate and bunch-up between the liner and bucket, thereby preventing the liner from being fully inserted.

Although the above has been found to be the easiest and most efficient method of inserting the liner, employing the apparatus of the present invention, other methods may be used; for example, subsequent to attaching the hook to the edge of the bucket the strap may be placed in a flat position along the inner sides and bottom of the bucket with the tail end extending beyond the edge of the bucket opposite the hook end. The liner may then be inserted while assuring that the tail end is not forced downward into the bucket.

Figure 7:
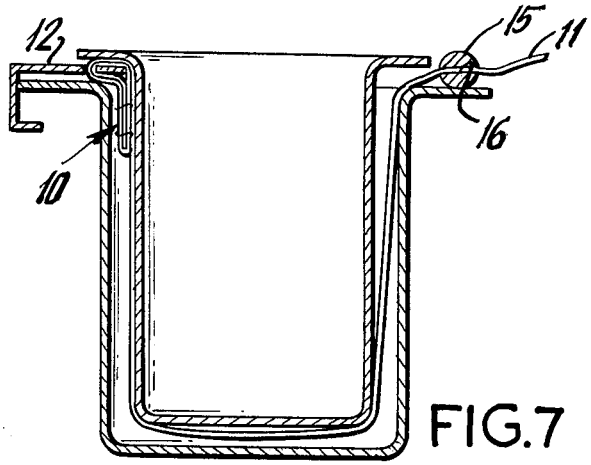
FIG. 7 is a vertical section view of a container or bucket depicting a liner fully inserted and the assist strap positioned between the liner and bucket.

The present invention also includes the use of a keeper 15 which prevents the tail end of strap 11 from creeping down into the bucket during prolonged use of the bucket and liner. As can be seen from the drawings keeper 15 comprises a tubular element provided with slot 16. Slot 16 is sized to frictionally and slidingly engage the tail end of strap 11. Once the liner is fully inserted keeper 15 is drawn up the tail end of strap 11 until it contacts the edge of the liner and bucket, as shown in FIG. 7. In this postion keeper 15 prevents the tail end of the strap 11 from being pulled down into the bucket during use.

In order to remove the liner from the bucket one need only pull the tail end of strap 11 either upward or outward. The force exerted on the tail end of strap 11 will result in an upward force being exerted on the bottom portion of the liner, resulting in the liner being raised from its fully inserted position.

When attaching the hook, care should be taken to attach it to an edge of the bucket which is opposite an accessible edge. This will ensure easy access to the tail end of strap when either inserting or removing the liner. In addition, the tail end of strap 11, which extends beyond the edge of the liner and bucket, should not be tied into a knot or loop, since this may cause the strap to become caught or entangled on a tree or other structure while the bucket is in motion, resulting in the liner being forced out of the bucket while an operator is within.

Although the apparatus of the present invention may be constructed of a variety of different materials known in the art, one should keep in mind when selecting the materials to be used the physical stresses to which the strap and hook are to be subjected, as well as the effect of long term exposure to the elements on such materials.

The use of aluminum or stainless steel is convenient for the construction of the hook portion of the present invention, since these metals are not only imperious to the elements but offer sufficient tensile strength for most applications. In addition they are capable of being die punched and easily bent into the appropriate form. With respect to the strap any appropriate material may be used, however, it has been found that the use of polypropylene web is most convenient, since not only does it possess sufficient strength, but is non-corrosive, easily secured to the hook, and most importantly allows the liner to slide with respect to the surface of the strap as it is being lifted out of the bucket, without damage to the liner.

Since from the foregoing the construction and advantage of the device may be readily understood, further explanation is believed to be unnecessary. However, since numerous modifications will readily occur to those skilled in the art after a consideration of the foregoing specification and accompanying drawings, it is not intended that the invention be limited to the exact construction shown and described, but all suitable modifications and equivalents may be resorted to which fall within the scope of the appended claims.

What is claimed is:

1. An apparatus for removing an electrical insulating liner from the bucket of an aerial lift type truck which comprises:

an elongated strap having attached to one end thereof a hook means, said hook means adapted to engage the upper edge portion of the bucket, said strap being of sufficient length to extend from the hook means down the corresponding inner side wall portion of the bucket across the bottom and up and beyond the opposite side wall portion of the bucket while the liner is fully inserted within the bucket.

2. The apparatus of claim 1 which further includes a keeper, said keeper being provided with a slot, said slot sized to frictionally and slidingly engage the tail end of said strap opposite the hook end, said keeper adapted to prevent the tail end from creeping into the bucket after the insertion of the liner.

3. The apparatus of claim 1 wherein the hook means is substantially U shaped and provided with a slot located in one of the extreme ends of the U for securing the strap.

4. The apparatus of claim 3 wherein the strap means is secured to the hook means by passing the end portion of said strap through the slot located on the hook means and permanently securing said end portion to that portion of the strap proximate to that end portion.

5. The apparatus of claim 1 wherein the hook means is made of metal selected from the group consisting of aluminum and stainless steel and the strap is made of polypropylene web.

6. The apparatus of claim 2 wherein said keeper is made from a resilient material.

7. A method of removing an electrical insulating liner from the bucket of an aerial lift type truck using the apparatus of claim 2 which comprises:

(a) attaching the hook means to an upper edge portion of the bucket;

(b) positioning the strap between the inner walls and bottom of the bucket and the outer side walls and bottom of the liner, when the liner is within the bucket, such that the tail end of the strap opposite the hook means extends beyond the edge of the bucket opposite the edge on which the hook means is attached;

(c) pulling the tail end of the strap resulting in the liner being forced from the bucket.

8. An apparatus for removing liners from their outer containers comprising:

(a) an elongated strap; and (b) means fixably attached to one end of the elongated strap for securing that end of the strap to the upper edge of the container from which the liner is to be removed, said elongated strap being of sufficient length to extend from the means for securing one end of the strap to the upper edge of the container down the inner wall of the container, across the bottom and up and beyond the opposite inner wall of the container while the liner is fully inserted within the bucket.

* * * * *